US010081032B2

(12) United States Patent
Rundo et al.

(10) Patent No.: US 10,081,032 B2
(45) Date of Patent: Sep. 25, 2018

(54) MULTI-BEAD APPLICATOR

(71) Applicant: Advantec Building Products, Newbury, OH (US)

(72) Inventors: John Rundo, Aurora, OH (US); Mark Rundo, Washington, DC (US); Ronald J. Janoski, Chagrin Falls, OH (US)

(73) Assignee: ADVANTEC BUILDING PRODUCTS, Newbury, OH (US)

( * ) Notice: Subject to any disclaimer, the term of this patent is extended or adjusted under 35 U.S.C. 154(b) by 7 days.

(21) Appl. No.: 15/364,789

(22) Filed: Nov. 30, 2016

(65) Prior Publication Data

US 2018/0147596 A1 May 31, 2018

(51) Int. Cl.

| | |
|---|---|
| ***B05C 5/02*** | (2006.01) |
| ***B05C 11/10*** | (2006.01) |
| ***B05C 21/00*** | (2006.01) |

(52) U.S. Cl.

CPC ..... *B05C 5/027* (2013.01); *B05C 11/1036* (2013.01); *B05C 11/1044* (2013.01); *B05C 21/00* (2013.01)

(58) Field of Classification Search

CPC ..... B05C 51/027; B05C 51/0279; B05C 51/0291; B05C 51/0283; B05C 51/0275; B05C 11/1036; B05C 11/1034; B05C 11/1044; B05C 21/00

USPC ..... 222/135, 608, 145.1, 145.5, 145.6, 326, 222/327, 185.1, 181.1–181.3; 118/305, 118/323, 612, 313–315; 427/207.1

See application file for complete search history.

(56) References Cited

U.S. PATENT DOCUMENTS

| | | | | |
|---|---|---|---|---|
| 5,865,549 | A | 2/1999 | Kinard et al. | |
| 6,220,526 | B1 | 4/2001 | Johnson | |
| 6,340,122 | B1 | 1/2002 | Kamstrup-Larsen | |
| 6,533,189 | B2 | 3/2003 | Kott et al. | |
| 6,942,735 | B2 | 9/2005 | Rich | |
| 7,056,556 | B2 * | 6/2006 | Burns | B05B 13/005 118/305 |
| 7,144,170 | B2 | 12/2006 | Parks et al. | |
| 7,815,384 | B2 | 10/2010 | Parks et al. | |
| 7,896,266 | B1 | 3/2011 | Cooper et al. | |
| 8,113,385 | B2 | 2/2012 | Choiniere et al. | |
| 8,132,693 | B2 | 3/2012 | Choiniere et al. | |
| 8,167,170 | B2 | 5/2012 | Choiniere et al. | |
| 8,251,603 | B2 | 8/2012 | Kott et al. | |
| 8,342,372 | B2 | 1/2013 | Choiniere et al. | |

(Continued)

*Primary Examiner* — Lien Ngo

(74) *Attorney, Agent, or Firm* — Pearne & Gordon LLP

(57) ABSTRACT

An applicator system includes a delivery apparatus and a dispenser assembly. The delivery apparatus includes a carrier configured to support first and second containers containing first and second liquids, the first and second containers having first and second outlets. The dispenser assembly includes a frame, a first distribution manifold removably connected to the frame, and a plurality of nozzles. The first distribution manifold includes an inlet and a plurality of outlets in fluid communication with the inlet. Each of the plurality of nozzles is removably fluidly coupled to a corresponding outlet of the first distribution manifold. The applicator system further includes a first hose, wherein one end of the first hose is removably fluidly coupleable to the inlet of the first distribution manifold and another end of the first hose is removably fluidly coupleable to at least one of the first outlet and the second outlet.

19 Claims, 7 Drawing Sheets

(56) References Cited

U.S. PATENT DOCUMENTS

| | | | | |
|---|---|---|---|---|
| 8,474,658 | B2 | 7/2013 | Choiniere et al. | |
| 8,668,699 | B2 | 3/2014 | Parks et al. | |
| 8,998,040 | B2 * | 4/2015 | Burns | F15B 15/00 222/262 |
| 9,089,869 | B2 * | 7/2015 | Galvin | B05C 5/0279 |
| 9,174,234 | B2 | 11/2015 | Snowwhite et al. | |
| 9,242,846 | B2 | 1/2016 | Burns | |
| 9,327,308 | B2 | 5/2016 | Choiniere et al. | |
| 9,381,536 | B2 * | 7/2016 | Galvin | B05C 17/00589 |
| 9,409,193 | B2 | 8/2016 | Parks et al. | |
| 9,610,604 | B2 * | 4/2017 | Galvin | B05C 5/0279 |
| 2005/0191433 | A1 | 9/2005 | Rich | |
| 2007/0217856 | A1 | 9/2007 | Kott et al. | |
| 2012/0012054 | A1 | 1/2012 | Galvin et al. | |
| 2012/0074167 | A1 * | 3/2012 | Galvin | B05C 5/0212 222/82 |
| 2012/0156371 | A1 * | 6/2012 | Snowwhite | B05C 5/0279 427/207.1 |
| 2013/0008376 | A1 | 1/2013 | Snowwhite et al. | |
| 2014/0283744 | A1 | 9/2014 | Galvin et al. | |
| 2015/0151324 | A1 | 6/2015 | Burns | |
| 2015/0283575 | A1 | 10/2015 | Miller et al. | |
| 2016/0207012 | A1 | 7/2016 | Burns | |

* cited by examiner

MULTI-BEAD APPLICATOR

TECHNICAL FIELD

This application relates generally to a multi-bead applicator and, more specifically, to a multi-bead applicator for roofing adhesive or other fluids.

BACKGROUND

The present disclosure relates to an applicator that can be used to apply adhesive or other fluids along a surface in a plurality of beads. There are a number of circumstances where an apparatus for concurrently applying a plurality of beads of a substance can be advantageously employed. For example, the construction of roofs for commercial and industrial buildings, typically, involves, as a first step, installing a corrugated steel decking having alternating peaks, or ribs, and valleys, or flutes. Thereafter, one or more layers of an insulating material are placed over the decking. Finally, one or more layers of a waterproof covering are placed over the insulating material. Conventionally, adhesives are used to secure the steel decking and the various layers of roofing materials together to form a, more-or-less, unitary covering for the roof. Such roofs, usually, are quite large, encompassing many square feet and, in some instances, the roofs cover several acres. Taking into account the sizes of the roofs that can be involved and the fact that several layers of roofing materials are typically applied, it is highly desirable that an apparatus be available that can rapidly apply large volumes of the adhesive to a relatively wide section of a roof in a single pass of the apparatus over the roofing materials. Thus, it can be desirable to have an applicator that simultaneously applies multiple, spaced apart, beads of adhesive along the roof in a single pass.

In some examples, it may be advantageous to have an applicator that applies a two-part adhesive formed by mixing two-adhesive reactants. Moreover, it may be advantageous to apply the two-part adhesive as a certain number of beads (e.g., four) in a single pass. In other applications, however, it may desirable to apply a one part adhesive. In addition or alternatively, it may desirable to change the number of beads simultaneously applied by the applicator. Thus, it is desirable to have an applicator that can be easily adapted to accommodate various applications.

SUMMARY

The following presents a simplified summary of the disclosure in order to provide a basic understanding of some example aspects described in the detailed description.

In one embodiment, an applicator system includes a delivery apparatus and a dispenser assembly located remotely from the delivery apparatus. The deliver apparatus includes a carrier configured to support a first container containing a first fluid and a second container containing a second fluid, the first container including a first outlet and the second container including a second outlet. The delivery apparatus further includes a discharge mechanism that is selectively operable to discharge the first fluid from the first container through the first outlet and discharge the second fluid from the second container through the second outlet. The dispenser assembly is movable with respect to the carrier and includes a frame, a first distribution manifold removably connected to the frame, and a plurality of nozzles. The first distribution manifold includes an inlet and a plurality of outlets in fluid communication with the inlet. Each of the plurality of nozzles is removably fluidly coupled to a corresponding outlet of the first distribution manifold. The applicator system further includes a first hose for fluidly coupling the delivery apparatus to the dispenser assembly. One end of the first hose is removably fluidly coupleable to the inlet of the first distribution manifold and another end of the first hose is removably fluidly coupleable to at least one of the first outlet of the first container and the second outlet of the second container.

In another embodiment, a dispenser assembly includes a frame, a first distribution manifold and a second distribution manifold removably connectable to the frame, and a plurality of nozzles. The first distribution manifold and the second distribution manifold each include an inlet and a plurality of outlets in fluid communication with the inlet. Each of the plurality of nozzles is removably fluidly coupleable to one or more outlets of the first distribution manifold and the second distribution manifold. The dispenser assembly is configured to be assembled according to a first configuration wherein the first distribution manifold and the second distribution manifold are both removably connected to the frame and each of the plurality of nozzles is removably fluidly coupled to a first corresponding outlet of the first distribution manifold and a second corresponding outlet of the second distribution manifold. The dispenser assembly is further configured to be assembled according to a second configuration wherein the first distribution manifold is removably connected to the frame without the second distribution manifold and each of the plurality of nozzles is removably fluidly coupled to a corresponding outlet of the first distribution manifold.

In another embodiment, a dispenser assembly includes a frame, a first distribution manifold and a substitute manifold removably connectable to the frame, and a plurality of nozzles. The first distribution manifold and the substitute manifold each include an inlet and a plurality of outlets in fluid communication with the inlet, the substitute manifold and the first distribution manifold having a different number of outlets. The dispenser assembly is configured to be assembled according to a first configuration wherein the first distribution manifold is removably connected to the frame and each of the plurality of nozzles is removably fluidly coupled to a corresponding outlet of the first distribution manifold. The dispenser assembly is further configured to be assembled according to a second configuration wherein the substitute manifold is removably connected to the frame and each outlet of the substitute manifold is removably fluidly coupled to a corresponding nozzle of the plurality of nozzles.

BRIEF DESCRIPTION OF THE DRAWINGS

Embodiments of the invention are better understood when the following detailed description is read with reference to the accompanying drawings, in which.

DETAILED DESCRIPTION

Figure 1:
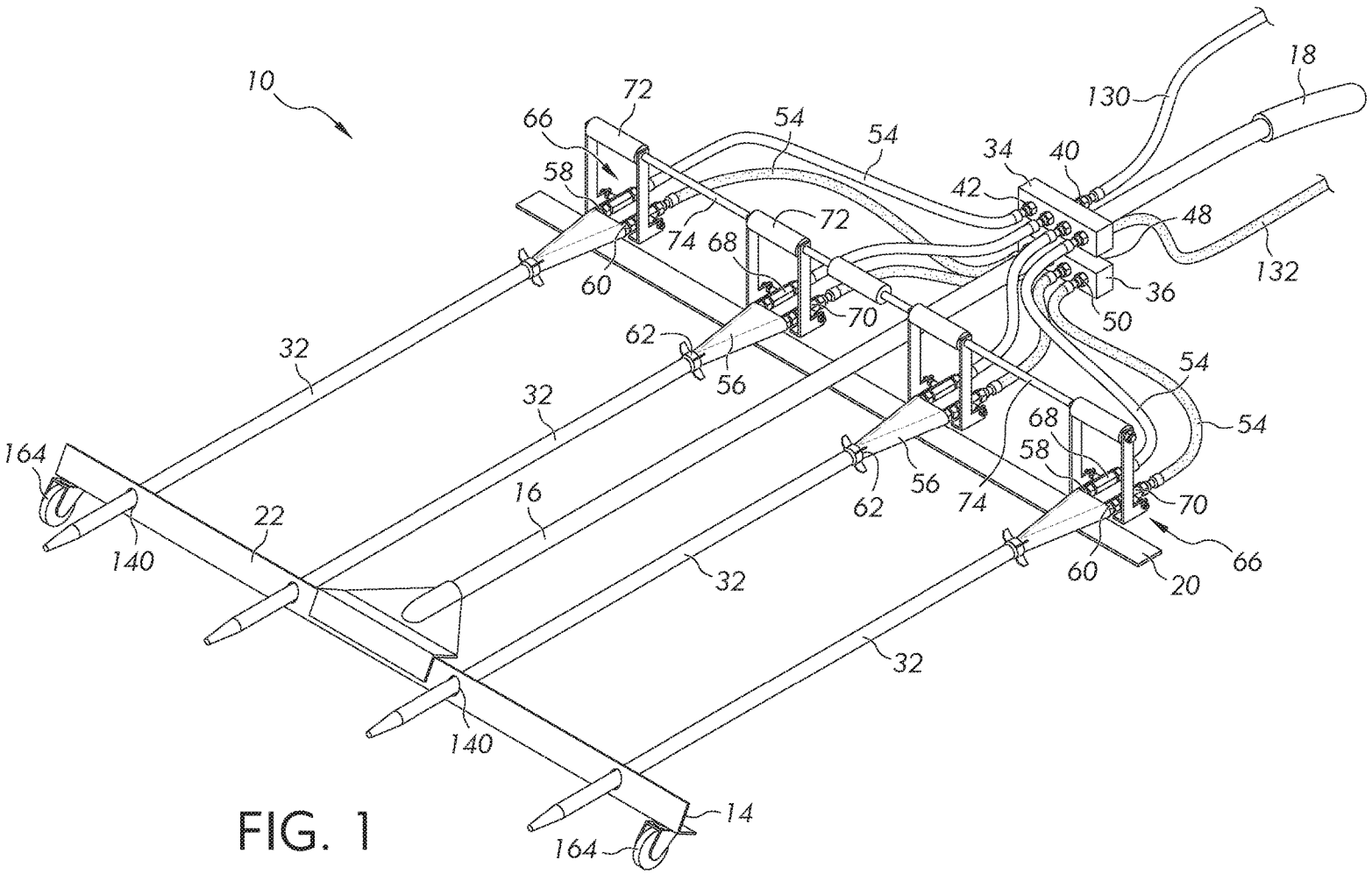
FIG. 1 is a perspective view of an example dispenser assembly assembled according to a first configuration.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is to be noted that the phrase "removably fluidly coupleable", as used herein when describing a first component in relation to a second component, means that the first component is configured such that the first component may be directly or indirectly fluidly coupled to the second component using removable coupling structure. More specifically, the first component will comprise structure that either forms part of a removable coupling structure or is adapted to cooperate with the removable coupling structure. For example, a first component that is removably fluidly coupleable to a second component may comprise a hose barb that is adapted to removably receive a hose fluidly coupled to the second component. In other examples, the first component may comprise a hose that can be removably received on a hose barb of the second component. The first component may be directly coupled to the second component or there may be structure intermediate of the first and second components such as, for example, a valve assembly, a manifold, or tubing.

An example dispenser assembly 10 is shown in FIG. 1 for applying adhesive and/or other fluids along a surface in a plurality of beads. The dispenser assembly 10 comprises a frame 14 including an elongated arm 16 extending along a longitudinal axis X that defines backward and forward directions of travel for the frame 14. The elongated arm 16 includes a handle 18 at an end portion thereof that permits a user to grip the elongated arm 16 and move the frame 14 backward or forward. The frame 14 further includes a first cross-member 20 and a second cross-member 22 that extend substantially parallel to each other along a direction transverse (e.g., substantially perpendicular) to the longitudinal axis X, though other non-parallel and/or transverse arrangements are possible. The first and second cross-members 20, 22 can be removably connected to various portions of the elongated arm 16 using, for example, threaded fasteners. However, the first and second cross-members 20, 22 can be removably connected to various portions of the elongated arm 16 using other structure such as, for example, slide mechanisms or clamping structure.

The dispenser assembly 10 further includes a plurality of nozzles 32 and first and second distribution manifolds 34, 36 for distributing fluid to the plurality of nozzles 32. The first distribution manifold 34 includes an inlet 40 and a plurality of outlets 42 that are in fluid communication with the inlet 40 such that fluid received through the inlet 40 is dispersed amongst the plurality of outlets 42 and expelled therefrom. Similarly, the second distribution manifold 36 includes an inlet 48 and a plurality of outlets 50 that are in fluid communication with the inlet 48 such that fluid received through the inlet 48 is dispersed amongst the plurality of outlets 50 and expelled therefrom. As will be described in further detail below, the inlets 40, 48 of the first and second distribution manifolds 34, 36 can be removably fluidly coupled to one or more hoses that deliver fluid to the inlets 40, 48.

The plurality of nozzles 32 can each be removably fluidly coupled to a corresponding outlet 42 of the first distribution manifold 34 and/or a corresponding outlet 50 of the second distribution manifold 36. For instance, as shown in the present example, the plurality of nozzles 32 can each be removably fluidly coupled to both a corresponding outlet 42 of the first distribution manifold 34 and a corresponding outlet 50 of the second distribution manifold 36 via a plurality of feed tubes 54 and a plurality of merging manifolds 56. More specifically, the number of merging manifolds 56 corresponds to the number of nozzles 32. Each merging manifold 56 comprises a first inlet 58, a second inlet 60, and an outlet 62 in fluid communication with the first and second inlets 58, 60 such that fluid entering the first and second inlets 58, 60 merges and is expelled through the outlet 62. The outlet 62 of each merging manifold 56 can be removably fluidly coupled to a corresponding one of the nozzles 32. Meanwhile, the first inlet 58 of each merging manifold 56 can be removably fluidly coupled to a corresponding outlet 42 of the first distribution manifold 34 via one of the feed tubes 54. Likewise, the second inlet 60 of each merging manifold 56 can be removably fluidly coupled to a corresponding outlet 50 of the second distribution manifold 36 via another one of the feed tubes 54.

The dispenser assembly 10 can further comprise one or more valve assemblies that are selectively operable to open and close fluid communication to one or more of the nozzles 32. For example, the dispenser assembly 10 can comprise a plurality of valve assemblies 66 corresponding to the number of nozzles 32. Each valve assembly 66 comprises a first valve 68 that is removably fluidly coupled between a corresponding feed tube 54 and the first inlet 58 of a corresponding merging manifold 56. Moreover, each valve assembly 66 comprises a second valve 70 that is removably fluidly coupled between another corresponding feed tube 54 and the second inlet 60 of its corresponding merging manifold 56. The first and second valves 68, 70 of each valve assembly 66 can be selectively operated to open and close fluid communication between the valve assembly's corresponding feed tubes 54 and merging manifold 56. In particular, the first and second valves 68, 70 of each valve assembly 66 can each comprise a ball valve that is rotatable between a first and second position to selectively open and close fluid communication between the valve assembly's corresponding feed tubes 54 and merging manifold 56. However, the type of valve used for each valve 68, 70 can vary and can comprise, for example, a gate valve or a globe valve. Moreover, in some examples, each valve assembly 66 may comprise only one of the first and second valves 68, 70. Each valve assembly 66 can comprise any number of valves fluidly coupled at any location such that the valve assembly 66 can open and close fluid communication to its corresponding nozzle 32.

In some examples, the plurality of valve assemblies 66 can be coupled to each other such that actuation of one valve assembly 66 causes actuation of the other valve assemblies 66. For example, each valve assembly 66 can comprise a handle 72 that is movable to actuate the valve assembly 66 and the handles 72 for every valve assembly 66 can be fixed to each other using one or more connection rods 74 such that moving the handle 72 of one valve assembly 66 causes the handles 72 of the remaining valve assemblies 66 to similarly move. By coupling the plurality of valve assemblies 66 to each other, fluid communication to the plurality of nozzles 32 can be simultaneously opened and closed for every nozzle 32.

Figure 2:
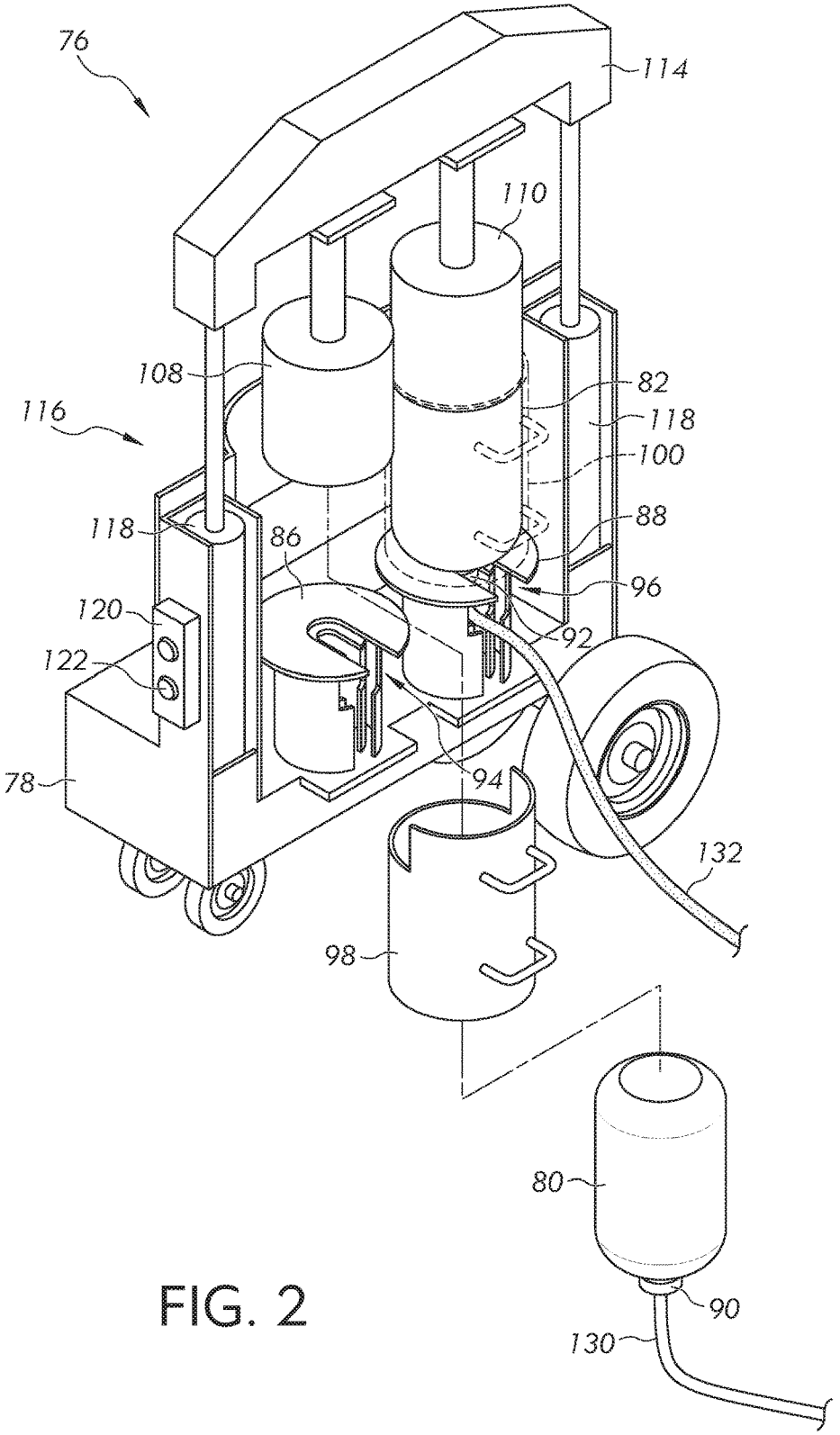
FIG. 2 is a partially exploded perspective view of an example delivery apparatus for the dispenser assembly.

The dispenser assembly 10 described above can be fluidly coupled to a delivery apparatus that is located remotely from the dispenser assembly 10 and is configured to deliver one or more fluids (e.g., adhesives) to the dispenser assembly 10. For instance, an example delivery apparatus 76 is shown in FIG. 2 that comprises a carrier 78 configured to support a first container 80 containing a first fluid and a second container 82 containing a second fluid. More specifically, the carrier 78 comprises a first platform 86 that the first container 80 can rest on and a second platform 88 that the second container 82 can rest on. The first and second containers 80, 82 respectively comprise first and second outlets 90, 92 that will extend through apertures 94, 96 in the first and second platforms 86, 88 when placed thereon. Moreover, first and second sleeves 98, 100 can be supported by the first and second platforms 86, 88 that surround the first and second containers 80, 82. However, the carrier 78 can comprise other structure in other examples that is configured to support the first and second containers 80, 82 such as, for example, a single platform that supports both containers 80, 82 with a single sleeve body that surrounds both containers 80, 82. The carrier 78 can comprise any structure that is configured to support the first and second containers 80, 82.

The fluids contained within the first and second containers 80, 82 can comprise a variety of different substances such as, for example, adhesives, lubricants, paints, etc. In some examples, the first fluid in the first container 80 can comprise a first part of a two-part adhesive and the second fluid in the second container 82 can comprise a second part of the two-part adhesive. However, the fluids contained within the first and second containers 80, 82 can comprise any type of fluid. Moreover, the fluids contained within the first and second containers 80, 82 can be different from each other in some embodiments and substantially identical to each other in other embodiments.

The delivery apparatus 76 can comprise a discharge mechanism that is selectively operable to discharge the fluids from the first and second containers 80, 82 through their respective outlets 90, 92 when the containers 80, 82 are provided on and supported by the carrier 78. For instance, the delivery apparatus 76 in the present example comprises a discharge mechanism 104 in the form of a hydraulic press that includes a first piston 108 and a second piston 110 that can be displaced vertically to apply pressure to the first and second containers 80, 82. As the first and second pistons 108, 110 are lowered through the first and second sleeves 98, 100, force is exerted by the first and second pistons 108, 110 on the first and second containers 80, 82 that will cause the containers 80, 82 to collapse and expel the fluids contained within though their respective outlets 90, 92.

In the present example, the first and second pistons 108, 110 of the discharge mechanism 104 are both driven by a common press bar 114 that can be selectively raised or lowered via a hydraulic drive assembly 116. The hydraulic drive assembly 116 includes two hydraulic cylinders 118 coupled to opposite sides of the press bar 114 and a control panel 120 with a user interface 122 that permits a user to selectively operate the hydraulic cylinders 118. The user interface 122 can comprise, for example, one or more push buttons, switches, touchscreens, etc. that permit a user to actuate the hydraulic cylinders 118 and selectively raise or lower the press bar 114. Since both the first and second pistons 108, 110 are driven by the press bar 114, pressure can be applied simultaneously and evenly by the first and second pistons 108, 110 to the first and second containers 80, 82 to simultaneously expel fluid from the containers 80, 82 at substantially similar rates.

It is to be appreciated that the discharge mechanism 104 can comprise a variety of different structure for discharging fluid from the first and second containers 80, 82. For example, the discharge mechanism 104 in some examples can comprise one or more pistons that are actuated without the use of hydraulics using, for instance, electrical and/or other mechanical means. In other examples, the discharge mechanism 104 can comprise one or more pumps that are fluidly coupled to the outlets 90, 92 of the containers 80, 82 and are configured to draw fluid from the containers 80, 82. Moreover, although the discharge mechanism 104 in the present example is configured to drive first and second pistons 108, 110 simultaneously to expel fluid from the containers 80, 82 at substantially similar rates, the discharge mechanism 104 in other examples may comprise structures (e.g., pistons, pumps, etc.) that are independently operable to expel fluid independently from the containers 80, 82 at different rates.

The dispenser assembly 10 can be located remotely from the delivery apparatus 76 and fluidly coupled thereto using one or more hoses such that fluid discharged by the delivery apparatus 76 will be delivered to the dispenser assembly 10 though the one or more hoses. For example, in some embodiments, a first hose 130 may be provided that is removably fluidly coupleable at one end to the first outlet 90 of the first container 80 and/or the second outlet 92 of the second container 82 and is removably fluidly coupleable at its other end to the inlet 40 of the first distribution manifold 34 and/or the inlet 48 of the second distribution manifold 36. For instance, as shown in FIGS. 1 & 2, the first hose 130 can be removably fluidly coupled at one end to the first outlet 90 of the first container 80 and at its other end to the inlet 40 of the first distribution manifold 34. However, the first hose 130 in other examples may be removably fluidly coupled to both the first outlet 90 of the first container 80 and the second outlet 92 of the second container 82 using, for example, a Y-connector assembly. In addition or alternatively, the first hose 130 may be removably fluidly coupled to both the inlets 40, 48 of the first and second distribution manifolds 34, 36 using, for example, a Y-connector assembly.

In some embodiments, a second hose 132 may be provided in addition or in alternative to the first hose 130 that is removably fluidly coupleable at one end to the first outlet 90 of the first container 80 and/or the second outlet 92 of the second container 82 and is removably fluidly coupleable at its other end to the inlet 40 of the first distribution manifold 34 and/or the inlet 48 of the second distribution manifold 36. For instance, as shown in FIGS. 1 & 2, the second hose 132 can be removably fluidly coupled at one end to the second outlet 92 of the second container 82 and at its other end to the inlet 48 of the second distribution manifold 36. However, the second hose 132 in other examples may be removably fluidly coupled to both the first outlet 90 of the first container 80 and the second outlet 92 of the second container 82 using, for example, a Y-connector assembly. In addition or alternatively, the second hose 132 may be removably fluidly coupled to both the inlets 40, 48 of the first and second distribution manifolds 34, 36 using, for example, a Y-connector assembly.

When the delivery apparatus 76 is fluidly coupled to the dispenser assembly 10 using the first hose 130 and/or the second hose 132, fluid discharged from the first and second containers 80, 82 by the discharge mechanism 104 of the delivery apparatus 76 can be delivered to the inlets 40, 48 of the first and second distribution manifolds 34, 36 via the hose(s). Moreover, the first and second hoses 130, 132 can be flexible to permit the dispenser assembly 10 to move with respect to the carrier 78 of the delivery apparatus 76. Thus, the delivery apparatus 76, the first and second hoses 130, 132, and the dispenser assembly 10 can form an applicator system that discharges fluid from the first and second containers 80, 82 and expels the fluid from the nozzles 32 of the movable dispenser assembly 10 at a location remote from the first and second containers 80, 82.

The delivery apparatus 76, the first and second hoses 130, 132, and the dispenser assembly 10 described above are configured such that a variety of different dispensing arrangements may be formed with the same or mostly the same components. For example, as described already and shown in FIGS. 1 & 2, the dispenser assembly 10 can be assembled according to a first configuration wherein the first and second distribution manifolds 34, 36 are removably connected to the elongated arm 16 of the frame 14. According to the first configuration, the first and second hoses 130, 132 respectively fluidly couple the first and second containers 80, 82 of the delivery apparatus 76 to the inlets 40, 48 of the first and second distribution manifolds 34, 36. Moreover, each of the nozzles 32 are removably fluidly coupled to a corresponding outlet 42 of the first distribution manifold 34 and a corresponding outlet 50 of the second distribution manifold 36 via the feed tubes 54 and merging manifolds 56. In particular, each merging manifold 56 is removably connected to the first cross-member 20 of the frame 14 and each nozzle 32 is arranged substantially parallel to the elongated axis X of the frame 14 such that each nozzle 32 extends from its corresponding merging manifold 56 and through an aperture 140 in the second cross-member 22. Furthermore, the valve assemblies 66 are coupled fluidly between the merging manifolds 56 and the first and second distribution manifolds 34, 36 by respectively coupling the first and second valves 68, 70 of each valve assembly 66 to the first and second inlets 58, 60 of its associated merging manifold 56.

When assembled according to the first configuration, the valve assemblies 66 can be selectively operated to open fluid communication between the merging manifolds 56 and the first and second distribution manifolds 34, 36. With fluid communication open, the discharge mechanism 104 of the delivery apparatus can be selectively operated to discharge the first and second fluids from the outlets 90, 92 of the first and second containers 80, 82. The first and second fluids will then flow through the first and second hoses 130, 132 to the inlets 40, 48 of the first and second distribution manifolds 34, 36, which will distribute the first and second fluids through the outlets 42, 50 of the first and second distribution manifolds 34, 36 to the merging manifolds 56. As the two fluids pass through the merging manifolds 56, the fluids will merge and flow from the outlets 62 of the merging manifolds 56 to the nozzles 32. The nozzles 32 will then dispense the merged fluids onto, for example, a substrate. To cease dispensing of the merged fluids, the valve assemblies 66 can be selectively operated to close fluid communication between the merging manifolds 56 and the first and second distribution manifolds 34, 36. As an alternative way to cease dispensing, the discharge mechanism 104 can be disengaged to cease discharge of the first and second fluids from the first and second containers 80, 82.

Figure 3:
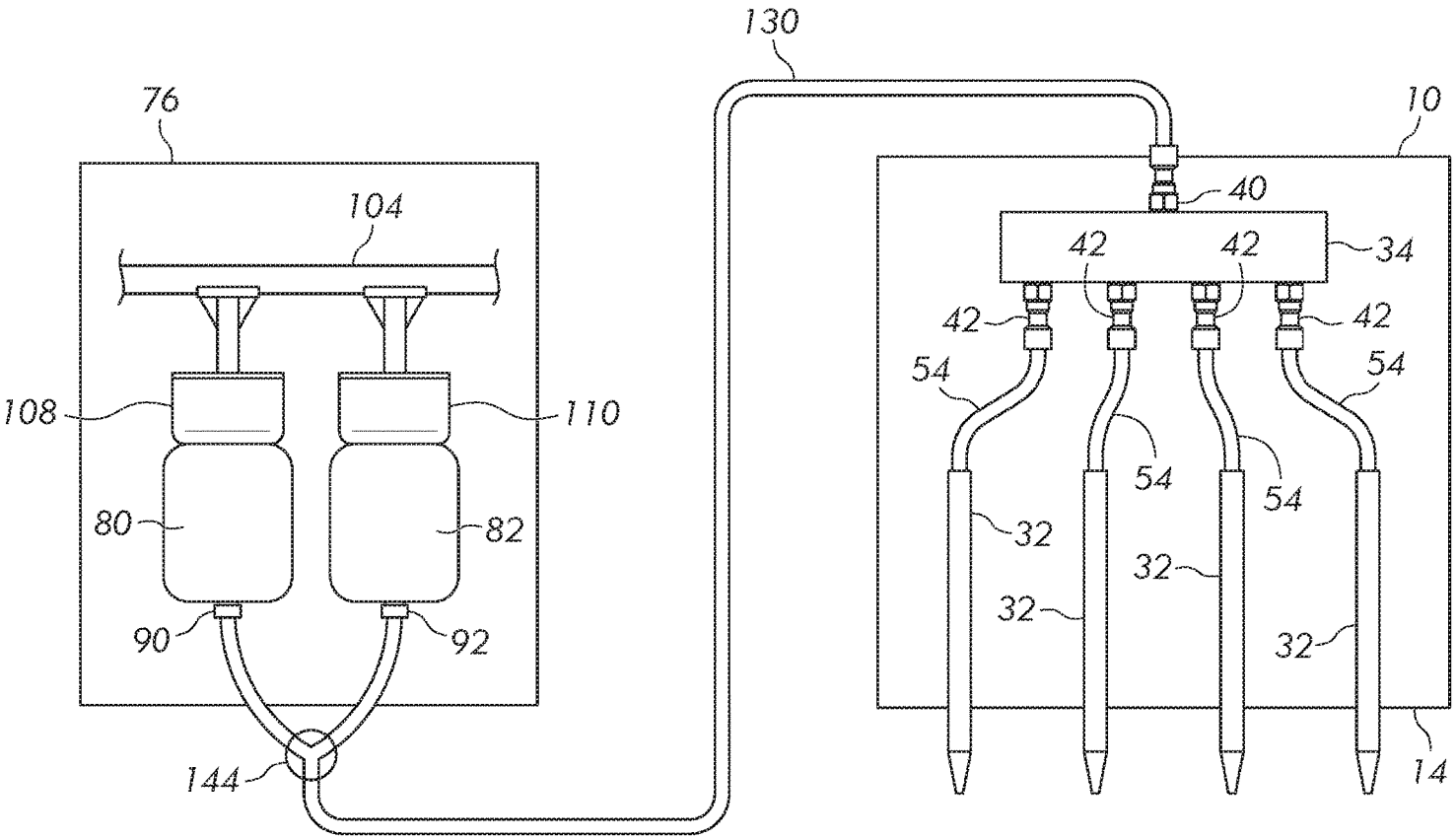
FIG. 3 is a schematic view of the dispenser assembly assembled according to a second configuration.

FIGS. 3-7 schematically show some alternative dispensing arrangements that can be provided using the delivery apparatus 76, the first and second hoses 130, 132, and the dispenser assembly 10. For example, as shown in FIG. 3, the dispenser assembly 10 can be assembled according to a second configuration wherein the first distribution manifold 34 is removably connected to the frame 14 without the second distribution manifold 36. According to the second configuration, the first hose 130 fluidly couples the inlet 40 of the first distribution manifolds 34 to both the first and second outlets 90, 92 of the containers 80, 82 using, for example, a Y-adapter 144. Moreover, each of the nozzles 32 is removably fluidly coupled to a corresponding outlet 42 of the first distribution manifold 34 via one of the feed tubes 54.

When assembled according to the second configuration, the discharge mechanism 104 of the delivery apparatus can be selectively operated to discharge the first and second fluids from the outlets 90, 92 of the first and second containers 80, 82. The first and second fluids will then merge within the first hose 130 and flow to the inlet 40 of the first distribution manifold 34, which will distribute the merged fluids through the outlets 42 of the second distribution manifold 34 to the nozzles 32. The nozzles 32 will then dispense the merged fluids onto, for example, a substrate. To cease dispensing of the merged fluids, the discharge mechanism 104 can be disengaged to cease discharge of the first and second fluids from the first and second containers 80, 82. As an alternative way to cease dispensing, valve assemblies can be installed to selectively close fluid communication between the outlets 90, 92 of the first and second containers 80, 82 and the nozzles 32.

Figure 4:
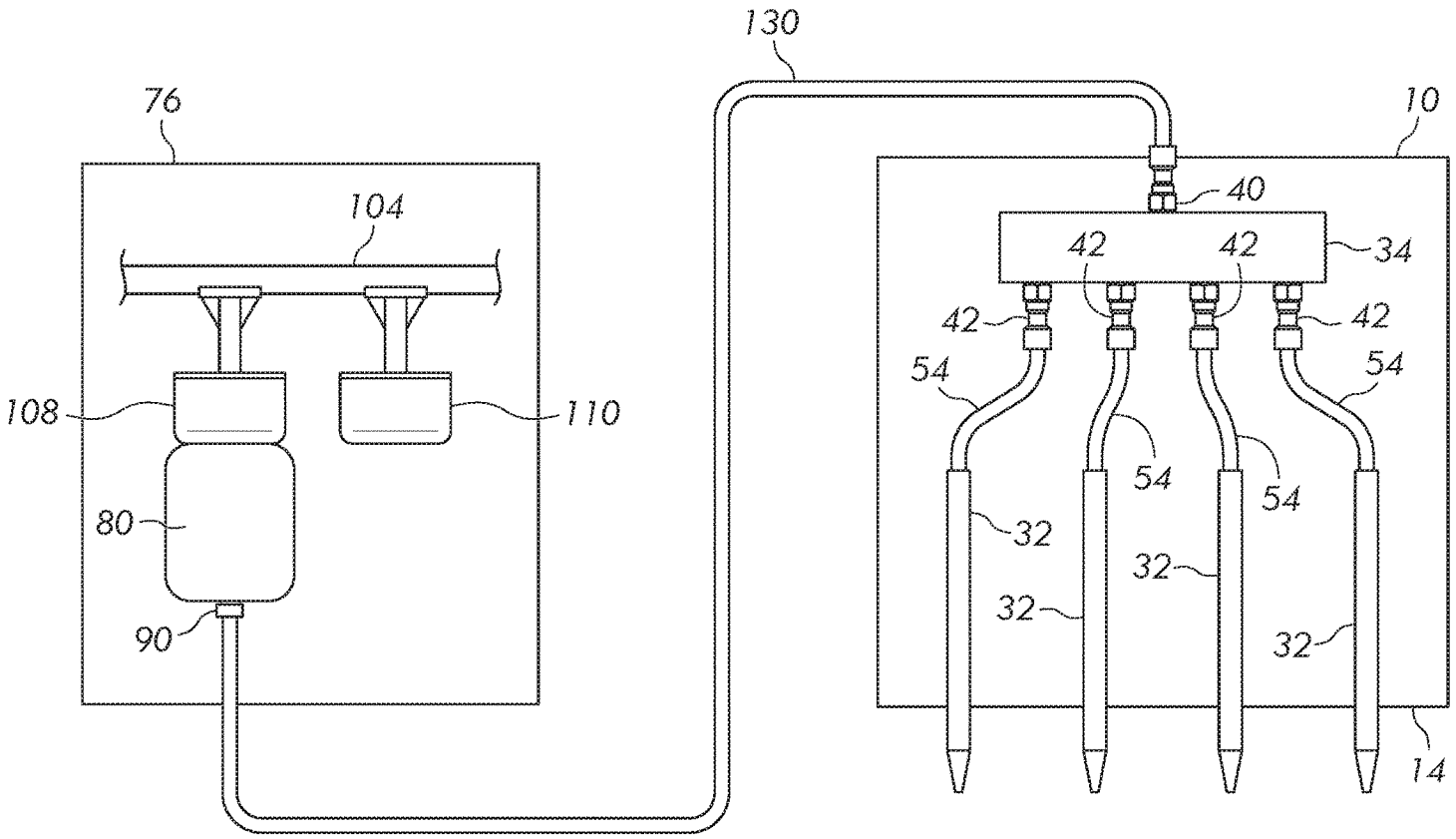
FIG. 4 is a schematic view of the dispenser assembly assembled according to a third configuration.

As shown in FIG. 4, the dispenser assembly 10 can be assembled according to a third configuration wherein the first distribution manifold 34 is removably connected to the frame 14 without the second distribution manifold 36. According to the third configuration, the first hose 130 fluidly couples the first outlet 90 of the first container 80 to the inlet 40 of the first distribution manifolds 34. Moreover, each of the nozzles 32 is removably fluidly coupled to a corresponding outlet 42 of the first distribution manifold 34 via one of the feed tubes 54. In the third configuration, the second container 82 can be absent and/or not fluidly coupled to the dispenser assembly 10.

When assembled according to the third configuration, the discharge mechanism 104 of the delivery apparatus can be selectively operated to discharge the first fluid from the outlet 90 of the first container 80. The first fluid will then flow through the first hose 130 to the inlet 40 of the first distribution manifold 34, which will distribute the first fluid through the outlets 42 of the first distribution manifold 34 to the nozzles 32. The nozzles 32 will then dispense the first fluid onto, for example, a substrate. To cease dispensing of the first fluid, the discharge mechanism 104 can be disengaged to cease discharge of the first fluid from the first container 80. As an alternative way to cease dispensing, valve assemblies can be installed to selectively close fluid communication between the outlet 90 of the first container 80 and the nozzles 32.

Figure 5:
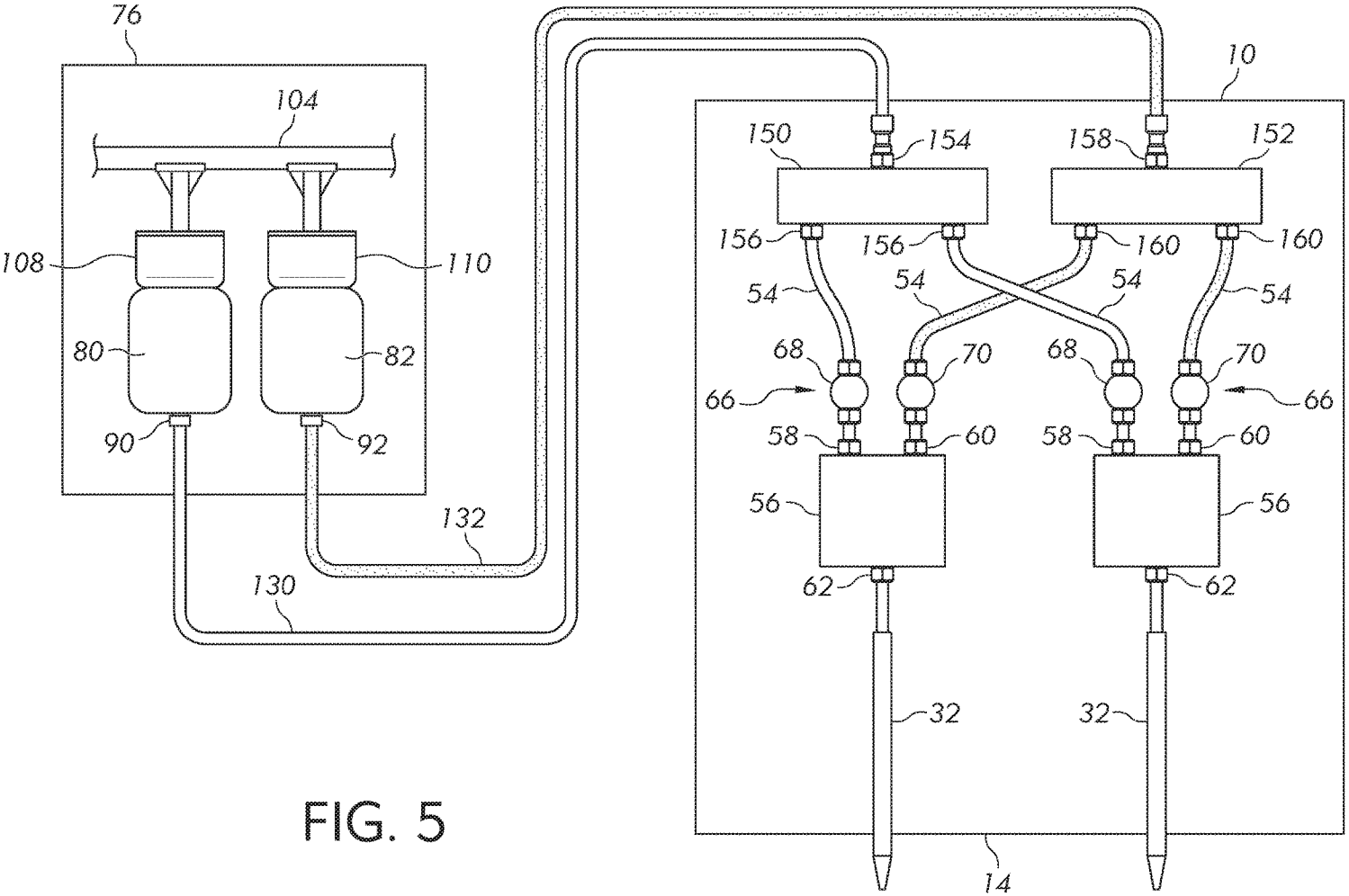
FIG. 5 is a schematic view of the dispenser assembly assembled according to a fourth configuration.

In some examples, the dispenser assembly 10 can comprise one or more substitute manifolds that can permit even further dispensing arrangements. For instance, as shown in FIG. 5, the dispenser assembly 10 can comprise first and second substitute manifolds 150, 152 that can be removably connected to the frame 14 in place of the first and second distribution manifolds 34, 36. The first substitute manifold 150 includes an inlet 154 and a plurality of outlets 156 that are in fluid communication with the inlet 154 such that fluid received through the inlet 154 is dispersed amongst the plurality of outlets 156 and expelled therefrom. Similarly, the second substitute manifold 152 includes an inlet 158 and a plurality of outlets 160 that are in fluid communication with the inlet 158 such that fluid received through the inlet 158 is dispersed amongst the plurality of outlets 160 and expelled therefrom. The inlets 154, 158 of the first and second substitute manifolds 150, 152 are removably fluidly coupleable to the first and second hoses 130, 132. Moreover, the outlets 156, 160 of the first and second substitute manifolds 150, 152 are each removably fluidly coupleable to one of the nozzles 32.

Preferably, the first and second substitute manifolds 150, 152 have a different number of outlets and/or inlets than the first and second distribution manifolds 34, 36. For instance, in the illustrated embodiments, the first and second distribution manifolds 34, 36 each have one inlet and four outlets while the first and second substitute manifolds 150, 152 each have one inlet and two outlets. However, each manifold may have other numbers of inlets and/or outlets without departing from the scope of the invention.

Since the first and second substitute manifolds 150, 152 have a different number of outlets and/or inlets than the first and second distribution manifolds 34, 36, the first substitute manifold 150 and/or the second substitute manifold 152 may be used in place of the first and second distribution manifolds 34, 36 to provide further alternative dispensing arrangements. For instance, as shown in FIG. 5, the dispenser assembly 10 can be assembled according to a fourth configuration wherein both the first and second substitute manifolds 150, 152 are removable connected to the frame 14 in place of the first and second distribution manifolds 34, 36. According to the fourth configuration, the first and second hoses 130, 132 respectively fluidly couple the first and second containers 80, 82 of the delivery apparatus 76 to the inlets 154, 158 of the first and second substitute manifolds 150, 152. Moreover, each outlet of the first and second substitute manifolds 150, 152 is removably fluidly coupled to a corresponding nozzle 32 via the feed tubes 54, valve assemblies 66, and merging manifolds 56. In particular, each outlet 156 of the first substitute manifold 150 is removably fluidly coupled to the first valve 68 of a corresponding valve assembly 66, which is removably fluidly coupled to the first inlet 58 of a corresponding merging manifold 56. Moreover, each outlet 160 of the second substitute manifold 152 is removably fluidly coupled to the second valve 70 of a corresponding valve assembly 66, which is removably fluidly coupled to the second inlet 60 of a corresponding merging manifold 56. The outlets 62 of the corresponding merging manifolds 56 are each removably fluidly coupled to a corresponding nozzle 32.

When assembled according to the fourth configuration, the valve assemblies 66 can be selectively operated to open fluid communication between the merging manifolds 56 and the first and second substitute manifolds 150, 152. With fluid communication open, the discharge mechanism 104 of the delivery apparatus can be selectively operated to discharge the first and second fluids from the outlets 90, 92 of the first and second containers 80, 82. The first and second fluids will then flow through the first and second hoses 130, 132 to the inlets 154, 158 of the first and second substitute manifolds 150, 152, which will distribute the first and second fluids through the outlets 156, 160 of the first and second substitute manifolds 150, 152 to the merging manifolds 56. As the two fluids pass through the merging manifolds 56, the fluids will merge and flow from the outlets 62 of the merging manifolds 56 to the nozzles 32. The nozzles 32 will then dispense the merged fluids onto, for example, a substrate. To cease dispensing of the merged fluids, the valve assemblies 66 can be selectively operated to close fluid communication between the merging manifolds 56 and the first and second distribution manifolds 34, 36. As an alternative way to cease dispensing of the merged fluids, the discharge mechanism 104 can be disengaged to cease discharge of the first and second fluids from the first and second containers 80, 82.

Figure 6:
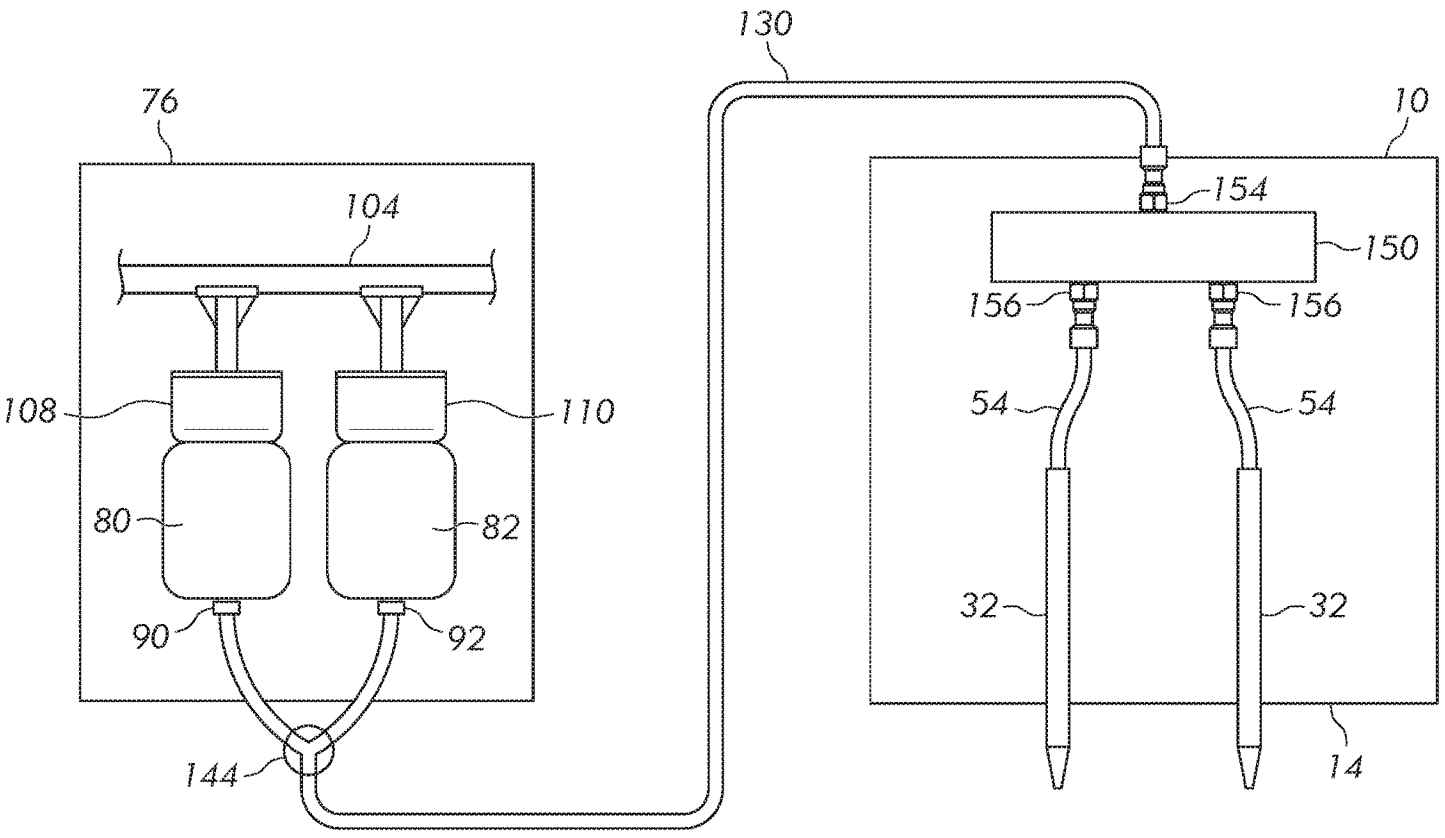
FIG. 6 is a schematic view of the dispenser assembly assembled according to a fifth configuration.

As shown in FIG. 6, the dispenser assembly 10 can be assembled according to a fifth configuration wherein the first substitute manifold 150 is removably connected to the frame 14 in place of the first and second distribution manifolds 34, 36 without the second substitute manifold 152. According to the fifth configuration, the first hose 130 fluidly couples the inlet 154 of the first substitute manifold 150 to both the first and second outlets 90, 92 of the containers 80, 82 using, for example, the Y-adapter 144. Moreover, each of the nozzles 32 is removably fluidly coupled to a corresponding outlet 156 of the first substitute manifold 150 via one of the feed tubes 54.

When assembled according to the fifth configuration, the discharge mechanism 104 of the delivery apparatus can be selectively operated to discharge the first and second fluids from the outlets 90, 92 of the first and second containers 80, 82. The first and second fluids will then merge within the first hose 130 and flow to the inlet 154 of the first substitute manifold 150, which will distribute the merged fluids through the outlets 156 of the first substitute manifold 150 to the nozzles 32. The nozzles 32 will then dispense the merged fluids onto, for example, a substrate. To cease dispensing of the merged fluids, the discharge mechanism 104 can be disengaged to cease discharge of the first and second fluids from the first and second containers 80, 82. As an alternative way to cease dispensing, valve assemblies can be installed to selectively close fluid communication between the outlets 90, 92 of the first and second containers 80, 82 and the nozzles 32.

Figure 7:
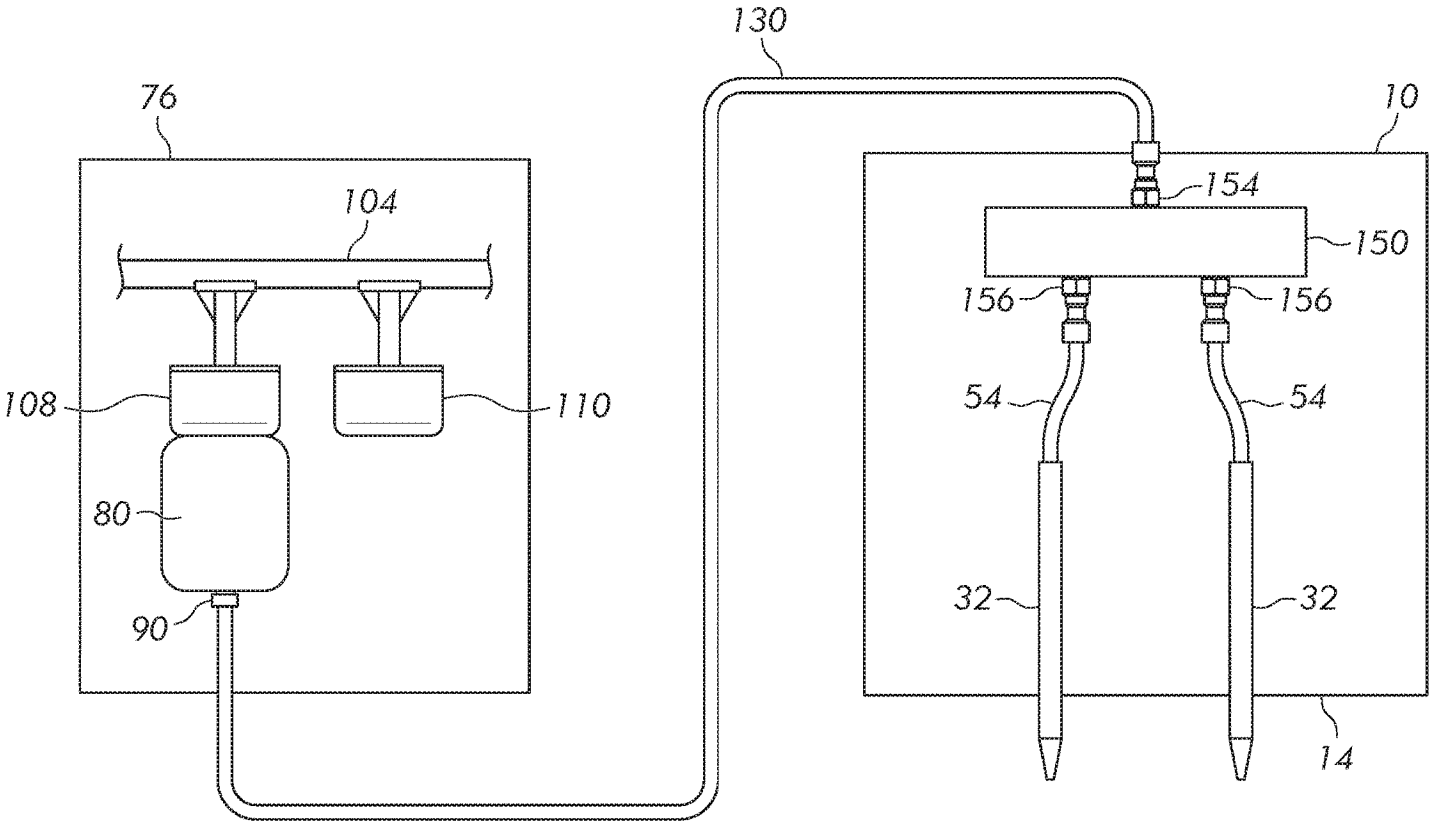
FIG. 7 is a schematic view of the dispenser assembly assembled according to a sixth configuration.

As shown in FIG. 7, the dispenser assembly 10 can be assembled according to a sixth configuration wherein the first substitute manifold 150 is removably connected to the frame 14 in place of the first and second distribution manifolds 34, 36 without the second substitute manifold 152. According to the sixth configuration, the first hose 130 fluidly couples the first outlet 90 of the first container 80 to the inlet 154 of the first substitute manifold 150. Moreover, each of the nozzles 32 is removably fluidly coupled to a corresponding outlet 156 of the first substitute manifold 150 via one of the feed tubes 54. In the sixth configuration, the second container 82 can be absent and/or not fluidly coupled to the dispenser assembly 10.

When assembled according to the sixth configuration, the discharge mechanism 104 of the delivery apparatus can be selectively operated to discharge the first fluid from the outlet 90 of the first container 80. The first fluid will then flow through the first hose 130 to the inlet 154 of the first substitute manifold 150, which will distribute the first fluid through the outlets 156 of the first substitute manifold 150 to the nozzles 32. The nozzles 32 will then dispense the first fluid onto, for example, a substrate. To cease dispensing of the first fluid, the discharge mechanism 104 can be disengaged to cease discharge of the first fluid from the first container 80. As an alternative way to cease dispensing, valve assemblies can be installed to selectively close fluid communication between the outlet 90 of the first container 80 and the nozzles 32.

By using removable fluid couplings for the dispenser assembly 10, the discharge mechanism 104, and the first and second hoses 130, 132, a variety of different dispensing arrangements may be assembled as described above using the same or mostly the same components. A variety of different types of removable fluid couplings may be utilized for each fluid coupling described above including, for example, threaded couplings, hose clamps or compression couplings. Preferably, multiple components comprise the same fitting to permit the components to be interchangeable without requiring the use of adapters or other structure to accommodate for differences in fittings. For example, the inlets 40, 48, 154, 158 of the manifolds 34, 36, 150, 152 preferably all comprise the same fitting such that the first and second hoses 130, 132 can be removably coupled to each inlet using the same coupling structure. As another example, the outlets 42, 50, 156, 160 of the manifolds 34, 36, 150, 152 preferably all comprise the same fitting such that the feed tubes 54 can be removably coupled to each outlet using the same coupling structure. As yet another example, the first and second valves 68, 70 of each valve assembly 66 preferably comprise the same fitting as each nozzle 32 such that the feed tubes 54 can be removably coupled directly to each nozzle 32 or directly to each of the first and second valves 68, 70 using the same coupling structure. Example fittings can include, for example, threaded collars, threaded bores, threaded inserts, hose barbs, pipe inserts or pipe sleeves. When the same fittings are used for multiple components, the fittings can be substantially identical in, for example, length, diameter, size, thread type, shape or material.

The dispenser assembly 10 described above thus can be easily adapted to accommodate a variety of different dispensing arrangements. For instance, if the dispenser assembly 10 is assembled according to the first configuration with both the first and second distribution manifolds 34, 36 removably connected to the frame 14, the first distribution manifold 34 and/or the second distribution manifold 36 may be disconnected and the dispenser assembly 10 may be reassembled according to any of the other configurations described above. For example, the second distribution manifold 36 may be disconnected and the dispenser assembly 10 may be reassembled according to the second or third configurations described above. As another example, the first and second distribution manifolds 34, 36 may both be disconnected and replaced with the first and second substitute manifolds 150, 152 and the dispenser assembly 10 may be reassembled according to the fourth configuration described above. As yet another example, the first and second distribution manifolds 34, 36 may both be disconnected and replaced with the first substitute manifold 150 and the dispenser assembly 10 may be reassembled according to the fifth or sixth configurations described above. The dispenser assembly 10 can be assembled according to any of the configurations described above and then reassembled according to any alternative configuration described above.

In some examples, the nozzles 32 can include screw threads or other structure within that will facilitate mixing of the merged fluids as they pass through the nozzles 32. Facilitation of mixing can be particularly advantageous for embodiments wherein the dispenser assembly 10 is fluidly coupled to both the first and second containers 80, 82 and the first and second fluids contained therein are substantially different and require mixing before being expelled.

Further in some examples, the dispenser assembly 10 can comprise one or more wheels 164 that are removable connectable to the frame 14 of the dispenser assembly 10, as shown in FIG. 1. The wheels 164 can rest upon a substrate and provide support for the dispenser assembly 10. As the dispenser assembly 10 is moved relative to the substrate, the wheels 164 can rotate and facilitate movement of the dispenser assembly 10.

Illustrative embodiments have been described, hereinabove. It will be apparent to those skilled in the art that various modifications and variations can be made without departing from the spirit and scope of the claimed invention. It is intended to include all such modifications and alterations within the scope of the present invention.

What is claimed is:

1. An applicator system comprising:

a delivery apparatus comprising:

a carrier configured to support a first container containing a first fluid and a second container containing a second fluid, the first container comprising a first outlet and the second container comprising a second outlet, and a discharge mechanism that is selectively operable to discharge the first fluid from the first container through the first outlet and discharge the second fluid from the second container through the second outlet;

a dispenser assembly located remotely from the delivery apparatus and movable with respect to the carrier, the dispenser assembly comprising:

a frame, a first distribution manifold removably connected to the frame and including an inlet and a plurality of outlets in fluid communication with the inlet, a plurality of nozzles, wherein each of the plurality of nozzles is removably fluidly coupled to a corresponding outlet of the first distribution manifold, and a plurality of valve assemblies corresponding to the plurality of nozzles, wherein each valve assembly is selectively operable to open and close fluid communication to its corresponding nozzle, further wherein the plurality of valve assemblies are coupled to each other such that actuation of one valve assembly causes actuation of another valve assembly; and a first hose for fluidly coupling the delivery apparatus to the dispenser assembly, wherein one end of the first hose is removably fluidly coupleable to the inlet of the first distribution manifold and another end of the first hose is removably fluidly coupleable to at least one of the first outlet of the first container and the second outlet of the second container.

2. The applicator system of claim 1, wherein the dispenser assembly further comprises:

a second distribution manifold removably connected to the frame and including an inlet and a plurality of outlets in fluid communication with the inlet, and a second hose for fluidly coupling the delivery apparatus to the dispenser assembly, wherein one end of the second hose is removably fluidly coupleable to the inlet of the second distribution manifold and another end of the second hose is removably fluidly coupleable to at least one of the first outlet of the first container and the second outlet of the second container.

3. The applicator system of claim 2, wherein the first hose is removably fluidly coupled to the inlet of the first distribution manifold and the second hose is removably fluidly coupled to the inlet of the second distribution manifold, further wherein the first hose is removably fluidly coupleable to the first outlet of the first container and the second hose is removably fluidly coupleable to the second outlet of the second container.

4. The applicator system of claim 2, further comprising a plurality of merging manifolds, wherein each of the plurality of merging manifolds includes a first inlet removably fluidly coupled to an outlet of the first distribution manifold, a second inlet removably fluidly coupled to an outlet of the second distribution manifold, and an outlet that is removably fluidly coupled to one of the plurality of nozzles and is in fluid communication with the first inlet and second inlet.

5. The applicator system of claim 1, wherein:

the dispenser assembly comprises a substitute manifold for replacing the first distribution manifold, the substitute manifold being removably connectable to the frame and including an inlet and a plurality of outlets in fluid communication with the inlet, the inlet of the substitute manifold being removable fluidly coupleable to the first hose and the plurality of outlets of the substitute manifold each being removably fluidly coupleable to one of the plurality of nozzles, and the substitute manifold and the first distribution manifold have a different number of outlets.

6. The applicator system of claim 1, wherein the frame comprises an elongated arm extending along a longitudinal axis and a pair of cross-members coupled to the elongated arm that extend substantially parallel to each other along a direction transverse to the longitudinal axis.

7. The applicator system of claim 1, wherein the discharge mechanism comprises a hydraulic press.

8. The applicator system of claim 7, wherein the discharge mechanism comprises a first piston and a second piston that can be displaced to apply pressure to the first container and the second container.

9. The applicator system of claim 8, wherein the first piston and the second piston are connected to a common press bar.

10. A dispenser assembly comprising:

a frame;

a first distribution manifold and a substitute manifold removably connectable to the frame, the first distribution manifold and the substitute manifold each including an inlet and a plurality of outlets in fluid communication with the inlet, the substitute manifold and the first distribution manifold having a different number of outlets; and a plurality of nozzles, wherein the dispenser assembly is configured to be assembled according to a first configuration wherein the first distribution manifold is removably connected to the frame and each of the plurality of nozzles is removably fluidly coupled to a corresponding outlet of the first distribution manifold, and wherein the dispenser assembly is configured to be assembled according to a second configuration wherein the substitute manifold is removably connected to the frame and each outlet of the substitute manifold is removably fluidly coupled to a corresponding nozzle of the plurality of nozzles.

11. The dispenser assembly according to claim 10, further comprising a second distribution manifold removably connectable to the frame and including an inlet and a plurality of outlets in fluid communication with the inlet, wherein the dispenser assembly is configured to be assembled according to a third configuration wherein the first distribution manifold and the second distribution manifold are both removably connected to the frame and each of the plurality of nozzles is removably fluidly coupled to a first corresponding outlet of the first distribution manifold and a second corresponding outlet of the second distribution manifold.

12. The dispenser assembly according to claim 10, further comprising a plurality of valve assemblies corresponding to the plurality of nozzles, wherein each valve assembly is selectively operable to open and close fluid communication to its corresponding nozzle, further wherein the plurality of valve assemblies are coupled to each other such that actuation of one valve assembly causes actuation of another valve assembly.

13. The dispenser assembly according to claim 12, wherein:

each valve assembly comprises a handle; and the handles of the plurality of valve assemblies are coupled to each other via one or more connection rods such that moving the handle of one valve assembly causes the handles of the remaining valve assemblies to move.

14. The applicator system of claim 1, wherein:

each valve assembly comprises a handle; and the handles of the plurality of valve assemblies are coupled to each other via one or more connection rods such that moving the handle of one valve assembly causes the handles of the remaining valve assemblies to move.

15. A dispenser assembly comprising:

a frame;

a first distribution manifold connected to the frame, the first distribution manifold including an inlet and a plurality of outlets in fluid communication with the inlet;

a plurality of nozzles, wherein each of the plurality of nozzles is fluidly coupled to a corresponding outlet of the first distribution manifold; and a plurality of valve assemblies corresponding to the plurality of nozzles, wherein each valve assembly is selectively operable to open and close fluid communication to its corresponding nozzle, further wherein the plurality of valve assemblies are coupled to each other such that actuation of one valve assembly causes actuation of another valve assembly.

16. The dispenser assembly of claim 15, wherein:

each valve assembly comprises a handle; and the handles of the plurality of valve assemblies are coupled to each other via one or more connection rods such that moving the handle of one valve assembly causes the handles of the remaining valve assemblies to move.

17. The dispenser assembly of claim 15, further comprising a second distribution manifold connected to the frame and including an inlet and a plurality of outlets in fluid communication with the inlet, wherein each of the plurality of nozzles is fluidly coupled to a corresponding outlet of the second distribution manifold.

18. The dispenser assembly of claim 17, further comprising a plurality of merging manifolds, wherein each of the plurality of merging manifolds includes a first inlet fluidly coupled to an outlet of the first distribution manifold, a second inlet removably fluidly coupled to an outlet of the second distribution manifold, and an outlet that is removably fluidly coupled to one of the plurality of nozzles and is in fluid communication with the first inlet and second inlet.

19. The dispenser assembly of claim 15, further comprising a substitute manifold for replacing the first distribution manifold, the substitute manifold being removably connectable to the frame and including an inlet and a plurality of outlets in fluid communication with the inlet, the plurality of outlets of the substitute manifold each being removably fluidly coupleable to one of the plurality of nozzles, wherein the substitute manifold and the first distribution manifold have a different number of outlets.

* * * * *